US011622432B1

(12) United States Patent
Loomis et al.

(10) Patent No.: US 11,622,432 B1
(45) Date of Patent: Apr. 4, 2023

(54) SERIAL-CONFIGURED LIGHTING DISPLAY WITH UPSTREAM DATA FLOW

(71) Applicant: Seasons 4, Inc., Toano, VA (US)

(72) Inventors: Jason Loomis, Decatur, GA (US); Zhanxiong He, Foshan (CN)

(73) Assignee: Seasons 4, Inc., Toana (VA)

( * ) Notice: Subject to any disclaimer, the term of this patent is extended or adjusted under 35 U.S.C. 154(b) by 0 days.

(21) Appl. No.: 17/649,897

(22) Filed: Feb. 3, 2022

(51) Int. Cl.
*H05B 45/20* (2020.01)
*H05B 45/46* (2020.01)

(52) U.S. Cl.
CPC ..... *H05B 45/46* (2020.01); *H05B 45/20* (2020.01)

(58) Field of Classification Search
CPC ..... H05B 45/10; H05B 45/20; H05B 45/30; H05B 45/40; H05B 45/46; H05B 47/10
See application file for complete search history.

(56) References Cited

U.S. PATENT DOCUMENTS

2021/0024225 A1* 1/2021 Cazzani ..... B64F 1/205

* cited by examiner

*Primary Examiner* — Jimmy T Vu
(74) *Attorney, Agent, or Firm* — Kinney & Lange, P.A.

(57) ABSTRACT

Apparatus and associated methods relate to a lighting display that has a plurality of independently-controllable lighting elements distributed therealong. The plurality of independently-controllable lighting elements are series-connected from a first, through intervening one(s), to a last of the plurality of independently-controllable lighting elements. The intervening one(s) of the plurality of independently-controllable lighting elements receiving input power from and providing an output control signal to an immediately preceding one of the plurality of independently-controllable lighting elements. The intervening one(s) of the plurality of independently-controllable lighting elements providing output power to and receiving an input control signal from an immediately succeeding ones of the plurality of independently-controllable lighting elements. Each of the intervening one(s) of the independently-controllable lighting elements provides the output power at an output voltage level and receives the input power at an input voltage level, the input voltage level being greater than the output voltage level.

21 Claims, 7 Drawing Sheets

SERIAL-CONFIGURED LIGHTING DISPLAY WITH UPSTREAM DATA FLOW

BACKGROUND

Lighting displays are used to communicate a joy of a holiday season, to draw attention to merchandise, or to simply decorate or adorn an object. Lighting displays can be used both indoors and outdoors. Lighting displays have been used residentially to adorn trees, shrubs, and houses. Commercial businesses can use lighting displays to provide festive atmospheres at their places of business. Even vehicles can be equipped with decorative lighting elements.

Some such decorations can involve many lighting displays. These lighting displays are often connected in series fashion. Series-connected lighting displays receive their operating power from a connector at a first end and deliver power to strings connected to a second end of the lighting display. Thus, a first lighting display in a series-connected chain of lighting displays carries the operating current for the entire series-connected chain of lighting displays. Conversely, a last lighting display in the series-connected chain will only carry the operating current for that last lighting display.

Lighting displays traditionally have been constructed using incandescent bulbs. Lighting displays that use incandescent bulbs often have been powered using AC line voltages. In more recently times, Light Emitting Diodes (LED) have been used in lighting displays. LEDs usually require low-voltage DC power for illumination. Therefore, lighting displays that use LEDs can be powered by low-voltage power levels. Providing a low-voltage power level to a series-connected chain of lighting displays, however, can result in high current levels.

Such high current levels can cause voltage droop along the series-connected chain, which in turn can cause the LEDs of the last lighting display to be noticeably dimmer than the LEDs of the first lighting display. Thus, a method of providing power to long chains of series-connected LED lighting displays that minimizes the dimming of the last lighting display of the chain is desired.

SUMMARY

Apparatus and associated methods related to a lighting display that includes a plurality of independently-controllable lighting elements distributed there-along. The plurality of independently-controllable lighting elements are series-connected from a first, through intervening one(s), to a last of the plurality of independently-controllable lighting elements. The last and each of the intervening one(s) of the plurality of independently-controllable lighting elements receive input power from and provide an output control signal to an immediately preceding one of the plurality of independently-controllable lighting elements. The first and each of the intervening one(s) of the plurality of independently-controllable lighting elements provide output power to and receive an input control signal from an immediately succeeding ones of the plurality of independently-controllable lighting elements. Each of the intervening one(s) of the independently-controllable lighting elements provides the output power at an output voltage level and receives the input power at an input voltage level, thereby having a voltage drop thereacross such that the input voltage level is greater than the output voltage level.

DETAILED DESCRIPTION

Apparatus and associated methods relate to a lighting display that has a plurality of independently-controllable lighting elements distributed therealong. The plurality of independently-controllable lighting elements are series-connected from a first, through intervening one(s), to a last of the plurality of independently-controllable lighting elements. The intervening one(s) of the plurality of independently-controllable lighting elements receiving input power from and providing an output control signal to an immediately preceding one of the plurality of independently-controllable lighting elements. The intervening one(s) of the plurality of independently-controllable lighting elements providing output power to and receiving an input control signal from an immediately succeeding ones of the plurality of independently-controllable lighting elements. Each of the intervening one(s) of the independently-controllable lighting elements provides the output power at an output voltage level and receives the input power at an input voltage level, the input voltage level being greater than the output voltage level.

These lighting displays can be any of the myriad lighting displays that are provided to the marketplace. For example, some embodiments can be decorative lighting displays, such as, for example, a Light Emitting Diode (LED) display. Such LED displays can also be of various configurations, such as LED strip lights, LED light bar, LED tube lights, LED light strings, etc.

Figure 1:
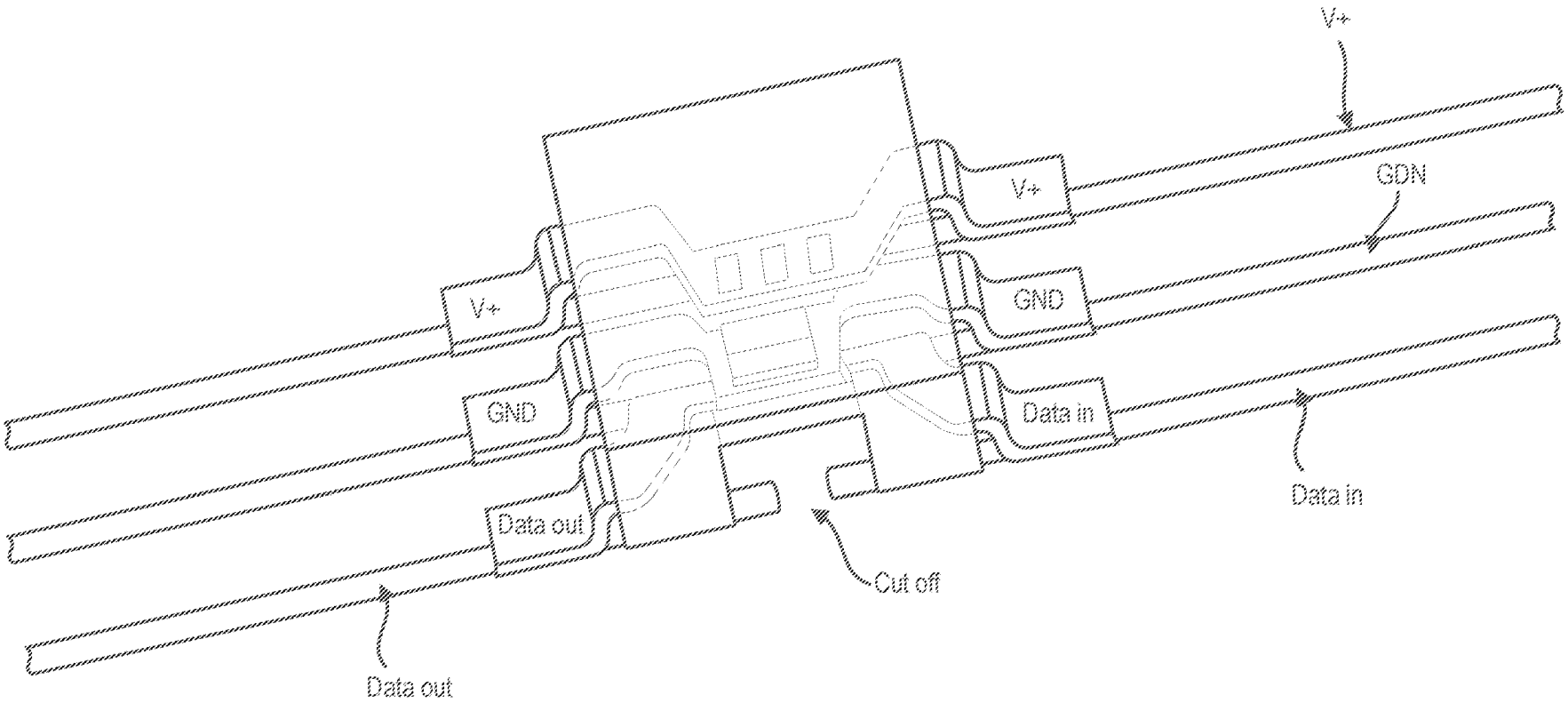
FIG. 1 is a perspective view of a parallel-configured LED package with cutout interposed between a data-in pin and a data-out pin.

FIG. 1 is a perspective view of a parallel-configured LED package with cutout interposed between a data-in pin and a data-out pin. In FIG. 1, parallel-configured LED package 10 includes top surface 12, leads DATA-IN, GND, and V+ that extend from lateral side 16, and opposite corresponding leads DATA-OUT, GND, and V+ that extend from lateral side 18. Parallel-configured LED package can have mirror symmetry about plane P perpendicular to top surface 12 and located halfway between lateral sides 16 and 18. Such a mirror configuration of leads facilitates conductive attachment of parallel-configured LED packages 10 with series of conductive wires so as to create a lighting display, as will be described in more detail below.

Parallel-configured LED package 10 houses color-controllable LED 20 and provides signal communication between color-controllable LED 20 and electrical conductors 22, 24, 26A, and 26B via package leads DATA-IN, DATA-OUT, GND, AND V+. In the embodiment depicted in FIG. 1, leads DATA-IN, DATA-OUT, GND, AND V+ have wire-connection surfaces that are coplanar with one another, such that when parallel-configured LED package 10 is set upon a plane with leads DATA-IN, DATA-OUT, GND, AND V+ down, all leads DATA-IN, DATA-OUT, GND, AND V+ rest upon the plane via their coplanar wire-connection surfaces. In some embodiments, instead of being coplanar, each of the wire-connection surfaces is concave so as to receive a rounded portion of a conductive wire therein. In such embodiments, the concave wire-connection surfaces are configured to simultaneously receive a series of parallel planar-aligned conductive wires (such as those depicted in FIG. 1) therein.

V+ leads are redundant positive power leads that conduct power from conductive wire 22 to color-controllable LED 20. GND leads are redundant power return leads that conduct the return power from color-controllable LED 20 to conductive wire 24. Lead DATA-IN is a data in lead that conductively communicates a data signal carried by conductive wire 26A to a data-in port of color-controllable LED 20. The data signal provided to the data-in port of color-controllable LED 20 contains information regarding the color and/or brightness that color-controllable LED 20 is to provide. The data signal provided to the data-in port of color-controllable LED 20 also contains information regarding the color and/or brightness that other downstream color-controllable LED(s), which color-controllable LED 20 will provide to conductive wire 26B via lead DATA-OUT.

Parallel-configured LED package 10 has cutout (or notch) 28 between leads DATA-IN and DATA-OUT extending from lateral sides 16 and 18, respectively. In some embodiments, such as the embodiment depicted in FIG. 1, cutout 28 is directly between, at least a portion of, leads DATA-IN and DATA-OUT. Cutout 28 is located between leads DATA-IN and DATA-OUT so as to provide space for a cutting tool to remove a section of conductive wire 26 previously extending between and conductively coupling leads DATA-IN and DATA-OUT. Conductive wire 26 (before being cut) is attached to leads DATA-IN and DATA-OUT. After leads DATA-IN and DATA-OUT have been attached to conductive wire 26, a cutter with tips extending into cutout 28, removes a segment of conductive wire 26, thereby severing conductive coupling of conductive wire 26A and 26B. By connecting a series of color-controllable LED packages to a single wire 26, and then removing a section located between oppositely aligned data-in and data-out leads, daisy chaining of such color-controllable LED packages is simplified. Such a notched package configuration facilitates manufacture of such serial daisy-chained devices. Furthermore, the notch provides visual indication of orientation of each of the serial-configured LED packages 10, so that such packages will not be attached to the lighting display with incorrect orientations.

Figure 2:
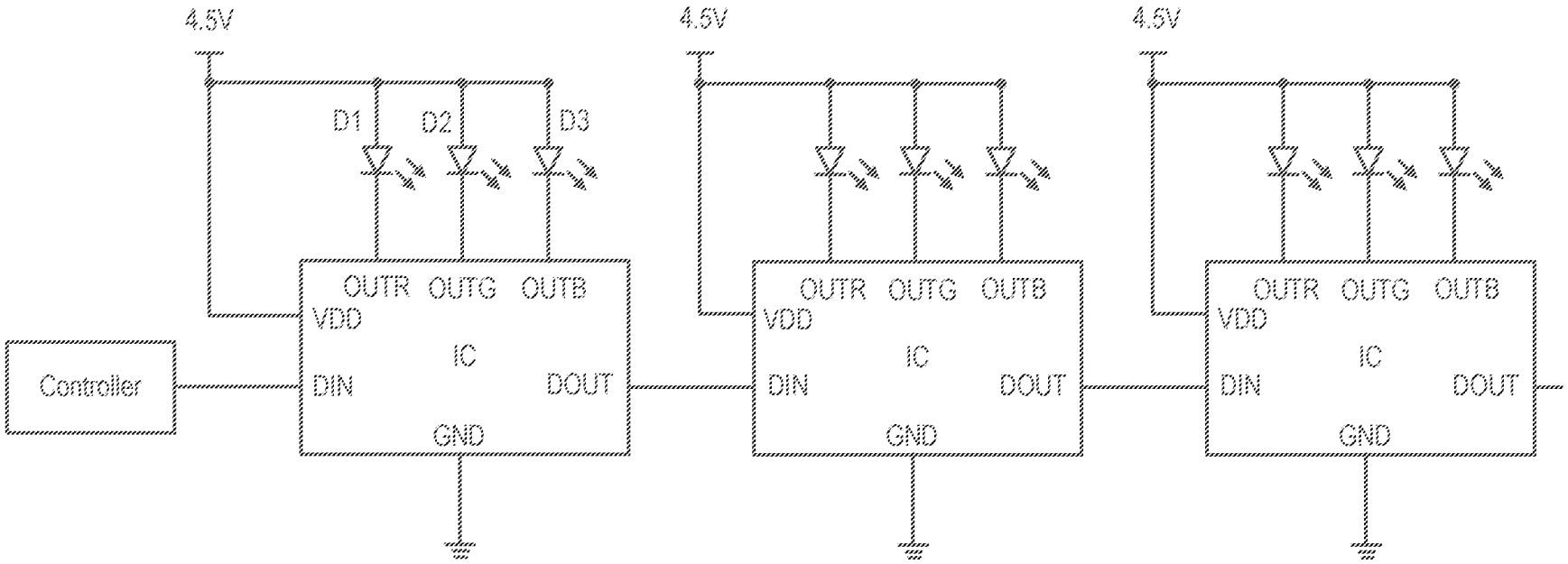
FIG. 2 is a schematic view of a lighting display using parallel-configured LEDs.

FIG. 2 is a schematic view of a lighting display using parallel-configured LEDs. In FIG. 2, lighting display 30 includes first, second and last parallel-configured LED packages 10A, 10B, and 10Z. Although only three parallel-configured LED packages—first, second and last parallel-configured LED packages 10A, 10B, and 10Z—are depicted, LED lighting display can have many such parallel-configured LED packages 10 between the second and last parallel-configured LEDs 10B and 10Z. Parallel-configured LED packages 10A, 10B, and 10Z are connected daisy-chain fashion via data-in and data-out ports, which correspond to data-in and data-out leads DATA-IN and DATA-OUT depicted in FIG. 1. Controller 32 generates data corresponding to a light show and provides the data to the data-in port of first parallel-configured LED package 10A. Color-controllable LED 20A housed by first parallel-configured LED package 10A is controlled according to a portion of the data received by data-in port, that portion pertaining to parallel-configured LED package 10A. Color-controllable LED 20A then strips the portion pertaining to parallel-configured LED package 10A and transmits the remaining data to downstream parallel-configured LED packages 10B and 10Z, via the data-out port of parallel-configured LED package 10A. In similar fashion, parallel-configured LED package 10B received the data provided to its data-in port, its color-controllable LED 20B responds to the data pertaining to parallel-configured LED package 10B, strips such data from the data stream and transmits the remaining data to parallel-configured LED package 10Z via the output port of parallel-configured LED package 10B. Subsequent parallel-configured LED packages 10 operate similarly, until either all data of the data stream has been stripped therefrom, or no more downstream parallel-configured LED packages 10 remain.

Figure 3:
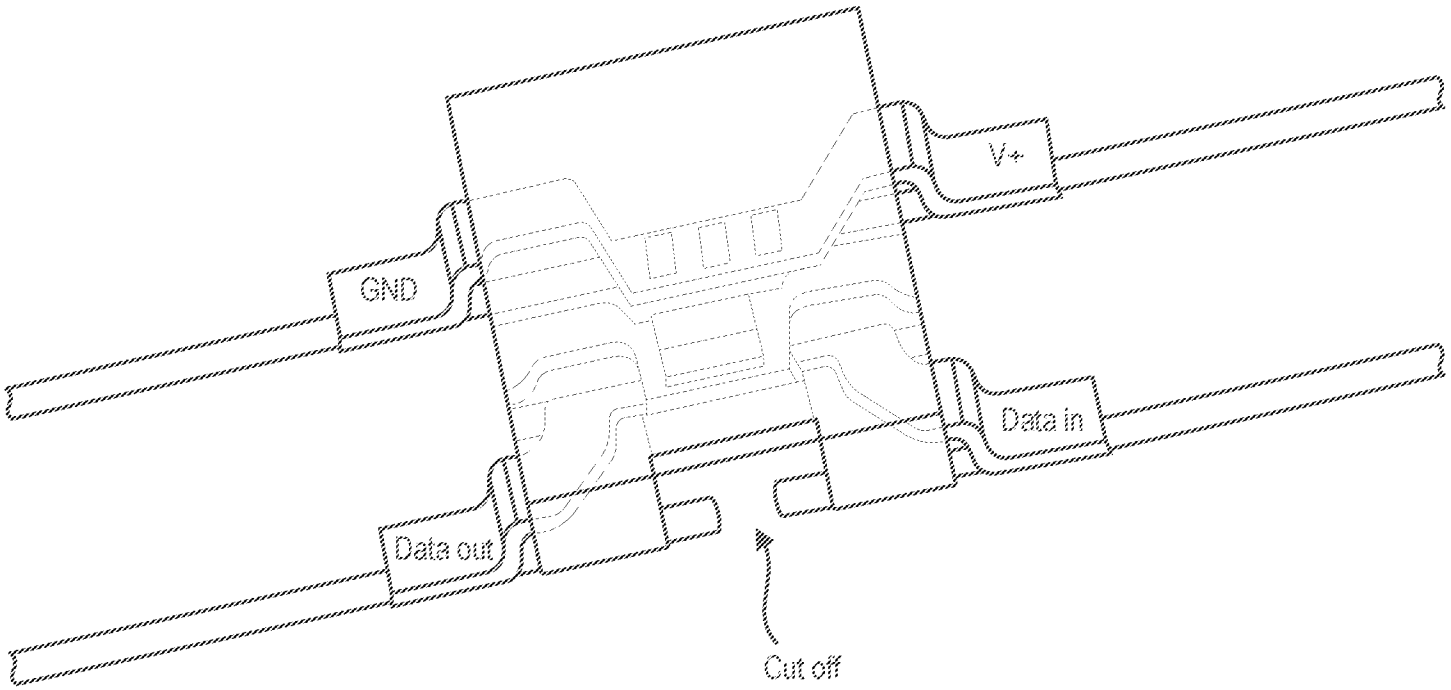
FIG. 3 is a perspective view of a serial-configured LED package with cutout interposed between a data-in pin and a data-out pin.

FIG. 3 is a perspective view of a serial-configured LED package with cutout interposed between a data-in pin and a data-out pin. In In FIG. 3, serial-configured LED package 10' includes top surface 12, leads DATA-IN and V+ that extend from lateral side 16, and opposite corresponding leads DATA-OUT and GND that extend from lateral side 18. Serial-configured LED package can have mirror symmetry about plane P perpendicular to top surface 12 and located halfway between lateral sides 16 and 18. Such a mirror configuration of leads facilitates conductive attachment of serial-configured LED packages 10' with series of conductive wires so as to create a lighting display, as will be described in more detail below.

Serial-configured LED package 10 houses color-controllable LED 20 and provides signal communication between color-controllable LED 20 and electrical conductors 22A, 22B, 26A, and 26B via package leads DATA-IN, DATA-OUT, V+, and GND. In the embodiment depicted in FIG. 3, leads DATA-IN, DATA-OUT, V+, and GND have wire-connection surfaces that are coplanar with one another, such that when serial-configured LED package 10' is set upon a plane with leads DATA-IN, DATA-OUT, V+, and GND down, all leads DATA-IN, DATA-OUT, V+, and GND rest upon the plane via their coplanar wire-connection surfaces. In some embodiments, instead of being coplanar, each of the wire-connection surfaces is concave so as to receive a rounded portion of a conductive wire therein. In such embodiments, the concave wire-connection surfaces are configured to simultaneously receive a series of parallel planar-aligned conductive wires (such as those depicted in FIG. 3) therein.

Lead V+ is a positive power lead that conducts power from conductive wire 22A to color-controllable LED 20. Lead GND serves as both a power return lead for serial-configured LED package 10' and a positive power lead for the next downstream serial-configured LED package daisy-chained to serial-configured LED package 10'. Lead DATA-IN is a data in lead that conductively communicates a data signal carried by conductive wire 26A to a data-in port of color-controllable LED 20. The data signal provided to the data-in port of color-controllable LED 20 contains information regarding the color and/or brightness that color-controllable LED 20 is to provide. The data signal provided to the data-in port of color-controllable LED 20 also contains information regarding the color and/or brightness that other downstream color-controllable LED(s), which color-controllable LED 20 will provide to conductive wire 26B via lead DATA-OUT. In the embodiment depicted in FIG. 3, direction that data is transmitted is from upstream (with regard to both data and voltage) serial-configured LED packages 10' to downstream serial-configured LED packages 10', which is the same direction that the direction electrical power is provided from package-to-package.

Serial-configured LED package 10' has cutout (or notch) 28 between leads DATA-IN and DATA-OUT extending from lateral sides 16 and 18, respectively. In some embodiments, such as the embodiment depicted in FIG. 3, cutout 28 is directly between, at least a portion of, leads DATA-IN and DATA-OUT. Cutout 28 is located between leads DATA-IN and DATA-OUT so as to provide space for a cutting tool to remove a section of conductive wire 26 previously extending between and conductively coupling leads DATA-IN and DATA-OUT. Conductive wire 26 (before being cut) is attached to leads DATA-IN and DATA-OUT. After leads DATA-IN and DATA-OUT have been attached to conductive wire 26, a cutter with tips extending into cutout 28, removes a segment of conductive wire 26, thereby severing conductive coupling of conductive wire 26A and 26B. By connecting a series of color-controllable LED packages to a single wire 26, and then removing a section located between oppositely aligned data-in and data-out leads, daisy chaining of such color-controllable LED packages 10' is simplified. Such a notched package configuration facilitates manufacture of such serial daisy-chained devices. Furthermore, the notch provides visual indication of orientation of each of the serial-configured LED packages 10', so that such packages will not be attached to the lighting display with incorrect orientations.

Figure 4:
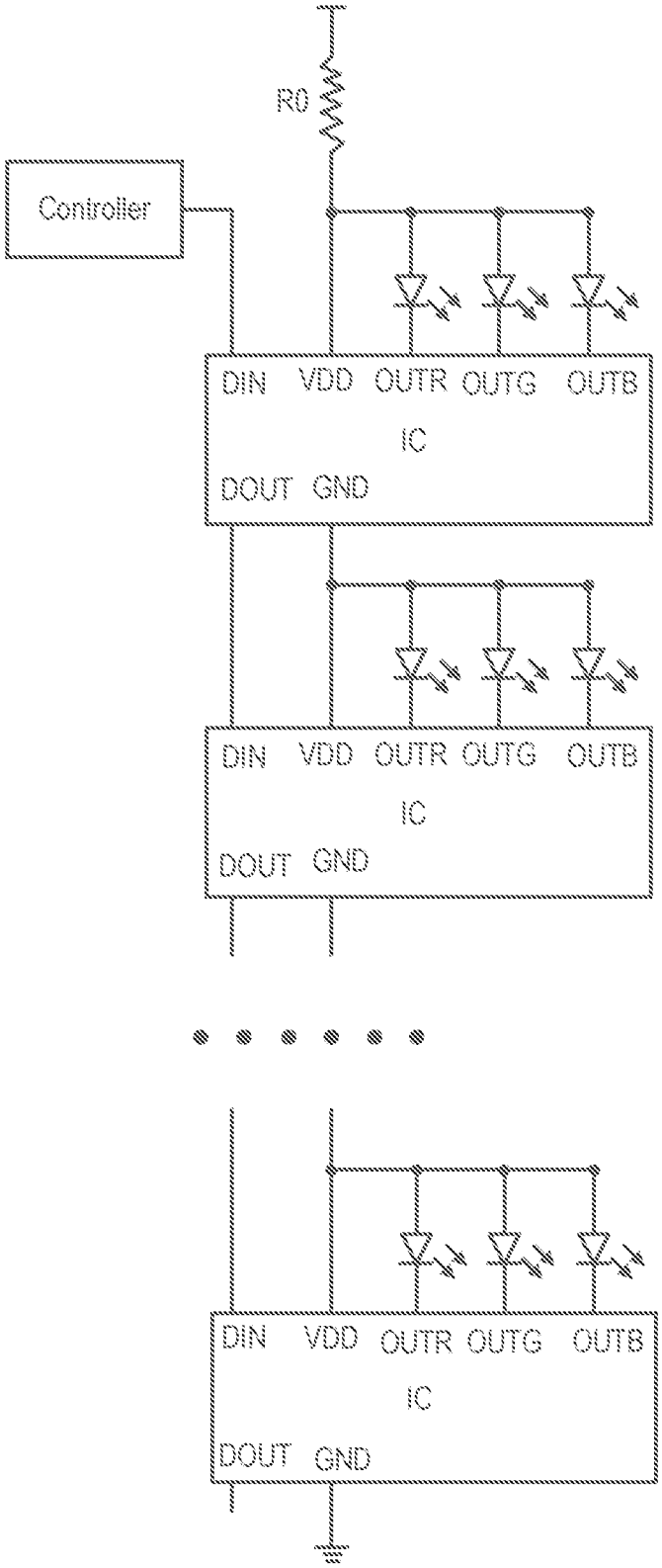
FIG. 4 is a schematic view of a lighting display using serial-configured LEDs.

FIG. 4 is a schematic view of a lighting display using serial-configured LEDs. In FIG. 2, lighting display 30' includes first, second and last serial-configured LED packages 10A', 10B', and 10Z'. Although only three serial-configured LED packages—first, second and last serial-configured LED packages 10A', 10B', and 10Z'—are depicted, LED lighting display can have many such serial-configured LED packages 10' between the second and last parallel-configured LEDs 10B and 10Z. Serial-configured LED packages 10A', 10B', and 10Z' are connected daisy-chain fashion via data-in and data-out ports, which correspond to data-in and data-out leads DATA-IN and DATA-OUT depicted in FIG. 1. Controller 32 generates data corresponding to a light show and provides the data to the data-in port of first serial-configured LED package 10A'. Color-controllable LED 20A housed by first serial-configured LED package 10A' is controlled according to a portion of the data received by data-in port, that portion pertaining to serial-configured LED package 10A'. Color-controllable LED 20A then strips the portion pertaining to serial-configured LED package 10A' and transmits the remaining data to downstream serial-configured LED packages 10B' and 10Z', via the data-out port of serial-configured LED package 10A'. In similar fashion, serial-configured LED package 10B received the data provided to its data-in port, its color-controllable LED 20B responds to the data pertaining to serial-configured LED package 10B', strips such data from the data stream and transmits the remaining data to serial-configured LED package 10Z via the output port of serial-configured LED package 10B'. Subsequent serial-configured LED packages 10' operate similarly, until either all data of the data stream has been stripped therefrom, or no more downstream serial-configured LED packages 10' remain.

Figure 5:
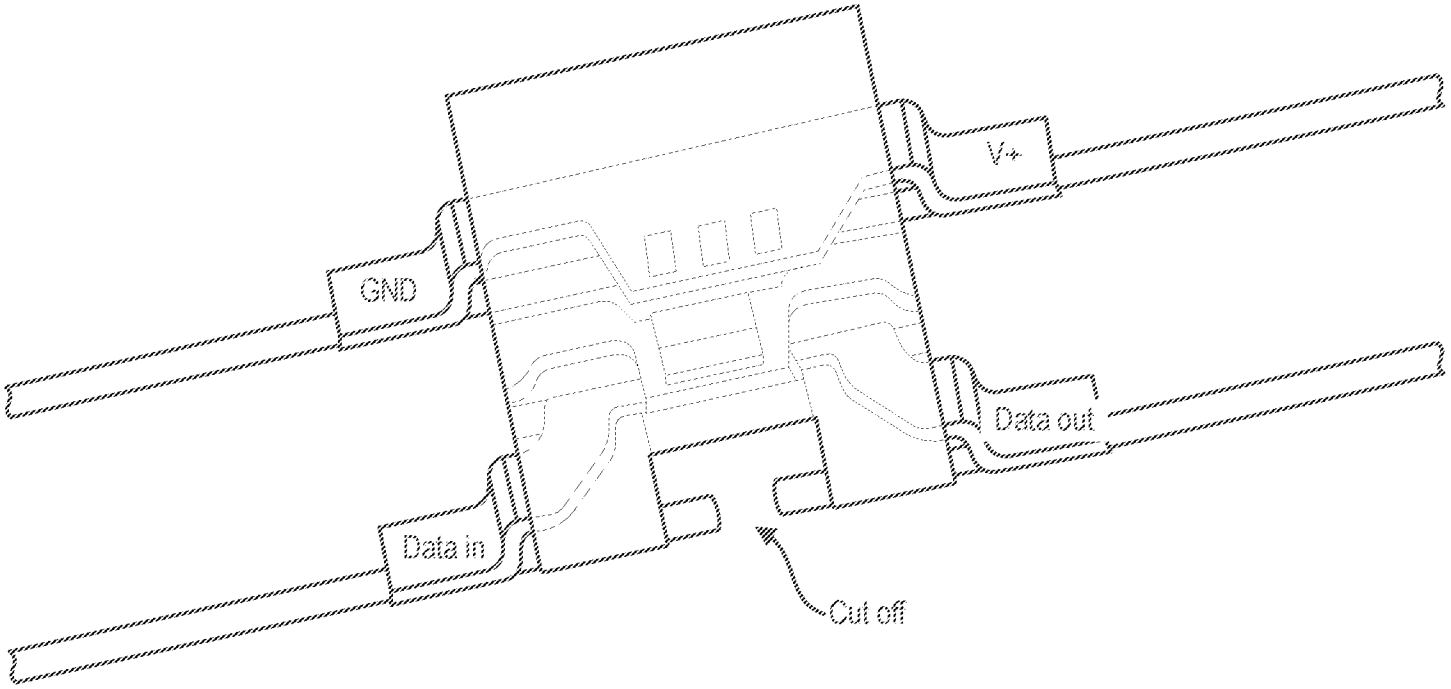
FIG. 5 is a perspective view of a serial-configured LED package with data propagation direction opposite a direction of supply current.

FIG. 5 is a perspective view of a serial-configured LED package with data propagation direction opposite a direction of supply current. Serial-configured LED package 10" depicted in FIG. 5 is like that of serial-configured LED package 10' depicted in FIG. 3 but with data-in lead DATA-IN and data-out lead DATA-OUT interchanged. Instead of having data-in lead on the same side 16 of serial-configured LED package 10' as the V+ lead V+, serial-configured LED package 10" has data-in lead DATA-IN on the opposite side 18 of serial-configured LED package 10' as the V+ lead V+. In the embodiment depicted in FIG. 5, direction that data is transmitted is from upstream (with regard to data) serial-configured LED packages 10' to downstream serial-configured LED packages 10', which is the opposite direction that the direction electrical power is provided from package-to-package In FIG. 5, serial-configured LED package 10" includes top surface 12, leads DATA-IN and V+, that extend from lateral side 16, and opposite corresponding leads DATA-OUT, GND, and V+ that extend from lateral side 18. Parallel-configured LED package can have mirror symmetry about plane P perpendicular to top surface 12 and located halfway between lateral sides 16 and 18. Like the embodiments depicted in FIGS. 1 and 3, serial-configured LED package 10" has cutout (or notch) 28 between leads DATA-IN and DATA-OUT extending from lateral sides 16 and 18, respectively. Cutout 28 is located between leads DATA-IN and DATA-OUT so as to provide space for a cutting tool to remove a section of conductive wire 26 previously extending between and conductively coupling leads DATA-IN and DATA-OUT.

Figure 6:
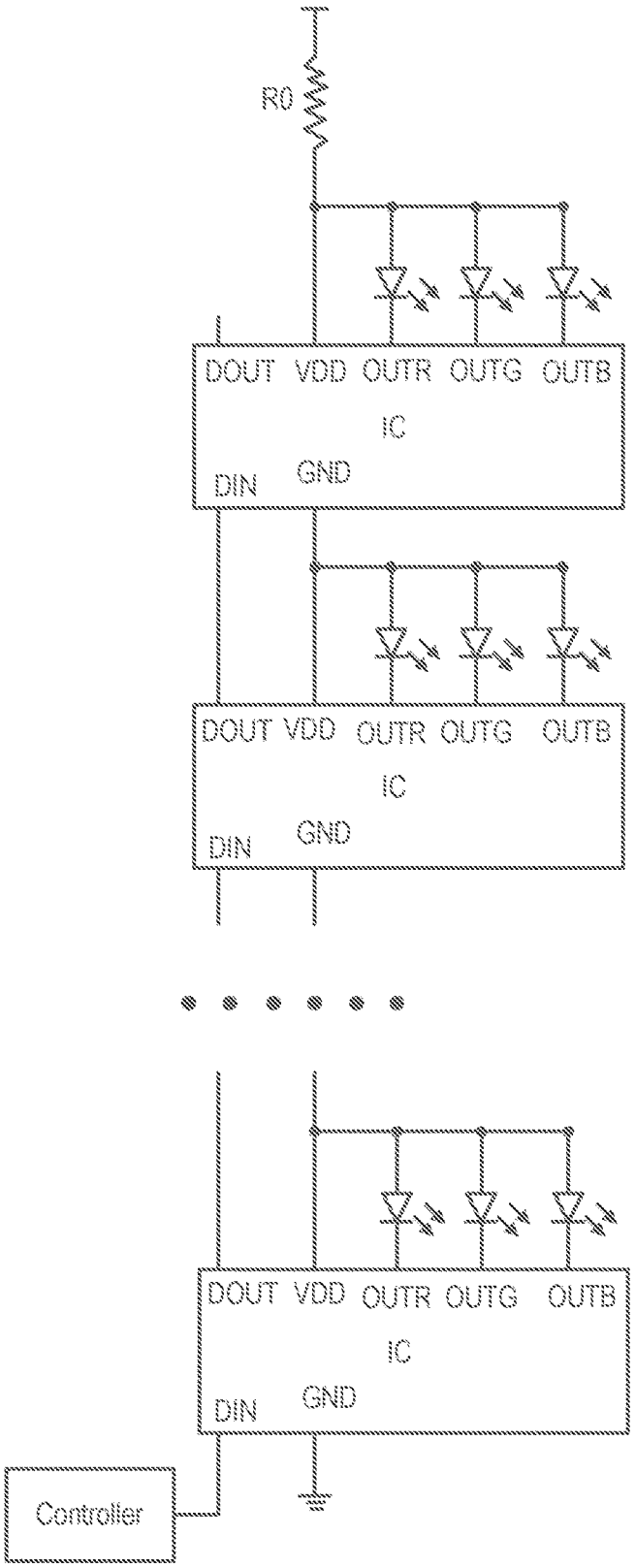
FIG. 6 is a schematic view of a lighting display using serial-configured LEDS with data propagation direction opposite a direction of supply current.

FIG. 6 is a schematic view of a lighting display using serial-configured LEDS with data propagation direction opposite a direction of supply current. Lighting display 30", as depicted in FIG. 6, differs from lighting display 30', as depicted in FIG. 4, in the direction of data flow with respect to direction of voltage drop. In the FIG. 4 embodiment controller 32 provides data only to the last serial-configured LED package 10Z'. In the FIG. 6 embodiment, however, controller 32 provides data only to the first serial-configured LED package 10Z". This oppositely directed flow of data can be advantageous in various applications. For example, for the embodiment depicted in FIG. 6, controller 32 need not level shift the voltage of the data so as to provide such data to a serial-configured LED package 10Z' that is biased to a high voltage level. Controller 32 can simply present data to a serial-configured LED package 10A" that is biased between GND and V+. Furthermore, in the FIG. 6 embodiment, a long GND/power-return line need not be strung to a distal end of lighting display 30", thereby compromising the voltage of such a GND/power-return line.

Figure 7:
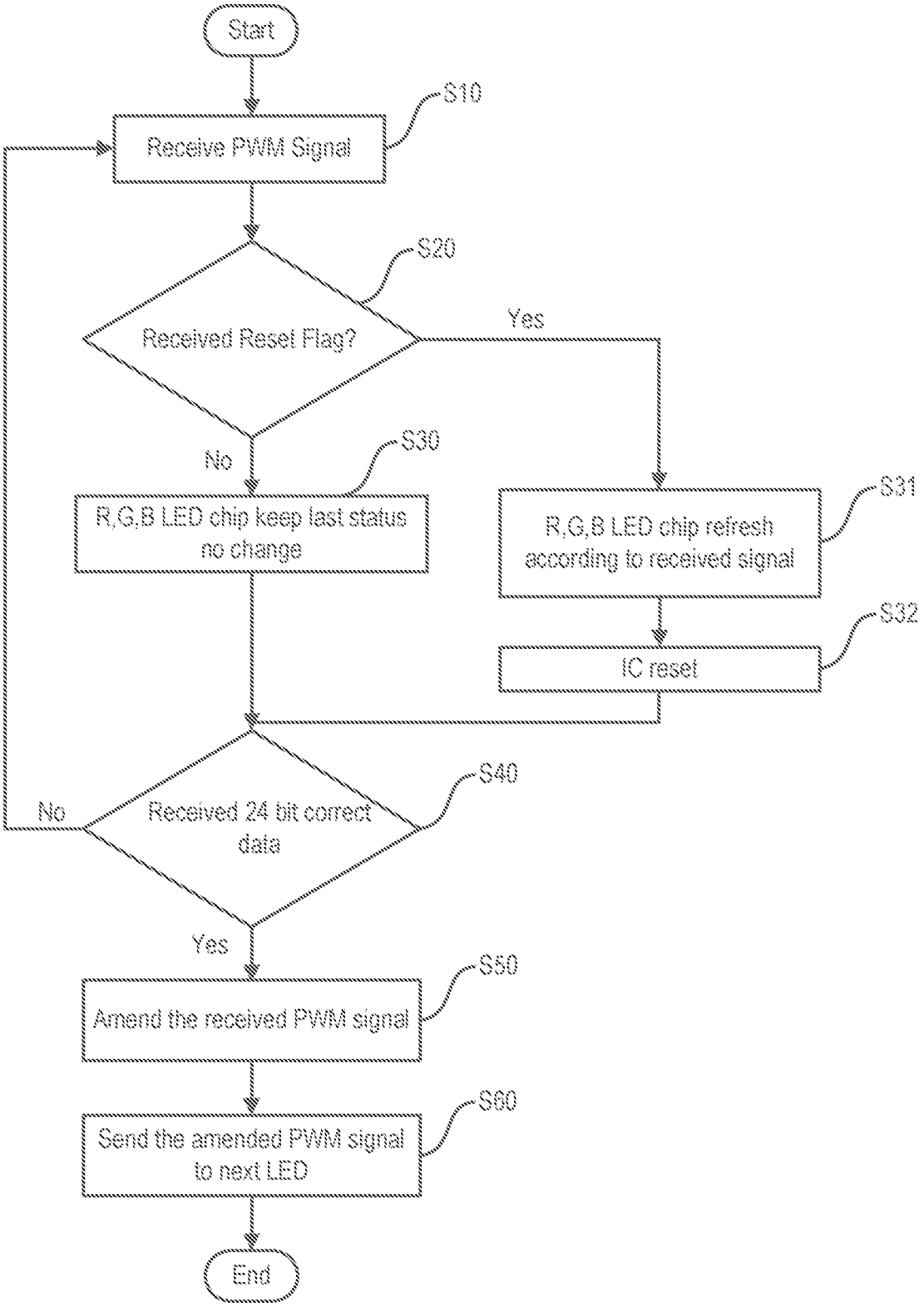
FIG. 7 is a flow chart of a method for manufacturing an LED lighting display using LED packages with cutout interposed between a data-in pin and a data-out pin.

FIG. 7 is a flow chart of a method for manufacturing an LED lighting display using LED packages with cutout interposed between a data-in pin and a data-out pin. In FIG. 7, method 40 in presented from the vantage point of color-controllable LED 20. Method 40 begins at step 42, where color-controllable LED 20 receives a PWM signal containing lighting control data for itself and for additional color-controllable LEDs located downstream (from a data perspective) therefrom. At step 44, color-controllable LED 20 determines whether the PWM signal received includes a reset flag. If, at step 44, color-controllable LED 20 determines that PWM signal received does include a reset flag, then method 40 proceeds to step 46, where color-controllable LED 20 refreshes its red R, green G, and blue B LEDs according to instructions contained in the PWM signal received. If, however, at step 44, color-controllable LED 20 determines that PWM signal received does not include a reset flag, then method 40 proceeds to step 48, where color-controllable LED 20 maintains the lighting signal provided by its red R, green G, and blue B LEDs. Regardless of the reset determination at step 44, method 40 continues to step 50, where color-controllable LED 20 determines whether the PWM signal received includes data for downstream LEDs. If, at step 50, color-controllable LED 20 determines that the PWM signal received includes data for downstream LEDs, method 40 proceeds to step 52, where color controllable LED 20 amends the received PWM signal (e.g., by stripping the data pertaining only to color-controllable LED 20). Then, at step 54, color controllable LED 20 transmits the amended data to downstream color controllable LEDs. If, however, at step 50, color-controllable LED 20 determines that the PWM signal received does not include data for downstream LEDs, method 40 returns to step 42, where color controllable LED 20 receives another PWM signal.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A lighting display comprising:

a plurality of independently-controllable lighting elements distributed about the lighting display, the plurality of independently-controllable lighting elements being series-connected from a first, through intervening one(s), to a last of the plurality of independently-controllable lighting elements, the last and each of the intervening one(s) of the plurality of independently-controllable lighting elements receiving input power from and providing an output control signal to an immediately preceding one of the plurality of independently-controllable lighting elements, the first and each of the intervening one(s) of the plurality of independently-controllable lighting elements providing output power to and receiving an input control signal from an immediately succeeding ones of the plurality of independently-controllable lighting elements, wherein each of the intervening one(s) of the independently-controllable lighting elements provides the output power at an output voltage level and receives the input power at an input voltage level, thereby having a voltage drop thereacross such that the input voltage level is greater than the output voltage level.

2. The lighting display of claim 1, wherein the control signal received by the last of the plurality of independently-controllable lighting elements contains data to provide independent control of each of the plurality of independently-controllable lighting elements.

3. The lighting display of claim 1, wherein the input control signal received by each of the plurality of series-connected lighting elements is configured to independently control a receiving one and all preceding ones of the independently-controllable lighting elements.

4. The lighting display of claim 1, wherein the output control signal provided by each of the plurality of independently-controllable lighting elements is configured to independently control the preceding ones of the independently-controllable lighting elements.

5. The lighting display of claim 1, wherein the plurality of independently-controllable lighting elements is connected such that power is provided to the lighting display by providing a high-voltage power signal to the first of the independently controllable lighting elements.

6. The lighting display of claim 5, wherein the high-voltage power signal has a voltage that is sufficient to provide maximal illumination of each of the plurality of independently-controllable lighting elements.

7. The lighting display of claim 1, wherein the power provided by each of the intervening one(s) of the plurality of series-connected lighting elements powers all succeeding ones of the plurality of independently-controllable lighting elements.

8. The lighting display of claim 1, wherein each of the plurality of independently-controllable lighting elements has, on a first side, an output control pin for providing the output control signal and an input power pin for receiving the input power, and has, on a second side opposite the first side, an input control pin for receiving the input control signal, and an output power pin for providing the output power.

9. The lighting display of claim 8, wherein the output control pin and input control pin are aligned directly opposite one another.

10. The lighting display of claim 9, wherein each of the plurality of independently-controllable lighting elements has a package cavity located between the output control pin and the input control pin, the cavity facilitating severing of a wire connected to both the output and input control pins so that the input and output pins are not short-circuited together after severing.

11. The lighting display of claim 10, wherein the package cavity is located directly between the input and output control pins.

12. The lighting display of claim 1, wherein each of the plurality of independently-controllable lighting elements includes a plurality of dissimilarly-colored light emitting diodes.

13. The lighting display of claim 1, wherein each of plurality of dissimilarly-colored light emitting diodes of each of the plurality of independently-controllable lighting elements is independently controllable based on the input control signal received.

14. The lighting display of claim 1, further comprising:

an electrical connector connected to the lighting display adjacent to the first of the plurality of independently-controllable lighting elements.

15. The lighting display of claim 14, wherein the electrical connector includes:

a high-voltage power contact conductively coupled to the first of the plurality of independently-controllable lighting elements so as to provide the input power thereto;

a control signal contact conductively coupled to the last of the plurality of independently-controllable lighting elements so as to provide the input control signal thereto; and a power return contact conductively coupled to the last of the plurality of independently-controllable lighting elements so as to provide a return path for power provided to the electrical connector.

16. The lighting display of claim 15, further comprising:

a rectifier conductively coupled to the high-voltage power pin, the rectifier rectifying AC power received from the high-voltage power pin and providing DC power to the plurality of the lighting elements of the lighting display.

17. The lighting display of claim 15, wherein the electrical connector is a first electrical connector connected, the lighting display further comprising:

a second electrical connector connected to the lighting display adjacent to the last of the plurality of independently-controllable lighting elements.

18. The lighting display of claim 17, wherein the lighting display is a decorative light string with the first electrical connector connected at a first end and the second electrical connector connected at a second end, wherein the second electrical connector includes:

a high-voltage power contact conductively coupled to the high-voltage power contact of the first electrical connector;

a control signal contact conductively coupled to the first of the plurality of independently-controllable lighting elements so as to receive the output control signal thereto; and a power return contact conductively coupled to power control contact of the first electrical connector.

19. The lighting display of claim 18, further comprising:

a first power conductors that extends from the first end to the second end of the lighting display and connects to each of the high-voltage power contacts of the first and second connector; and a second power conductor that extends from the first end to the second end of the lighting display and connects to each of the power return contacts of the first and second connector.

20. The lighting display of claim 1, wherein each of the plurality of independently-controllable lighting elements has an opto-coupler that facilitates level-shifting of the input control signal received.

21. The lighting display of claim 1, wherein each of the plurality of independently-controllable lighting elements has an capacitor that facilitates level-shifting of the input control signal received.

* * * * *